US005664266A

United States Patent [19]

Williams et al.

[11] Patent Number: 5,664,266

[45] Date of Patent: Sep. 9, 1997

[54] COMBINATION PATIENT TRANSPORTER CHAIR OR COMMODE

[75] Inventors: Glen Williams, Town of Mount Royal; Arnold Zidulka, Montreal, both of Canada

[73] Assignee: McGill University, Montreal, Canada

[21] Appl. No.: 711,858

[22] Filed: Sep. 12, 1996

Related U.S. Application Data

[63] Continuation-in-part of Ser. No. 344,658, Nov. 18, 1994, abandoned.

[30] Foreign Application Priority Data

Nov. 18, 1993 [GB] United Kingdom ..... 9323746

[51] Int. Cl.[6] ..... A61G 7/10

[52] U.S. Cl. ..... 5/86.1; 5/83.1; 297/DIG. 4; 297/6

[58] Field of Search ..... 5/86.1, 83.1, 81.1, 5/507.1; 297/440.22, 344.19, 172, 174, 423.27, 423.26, DIG. 4, 441, 452.18, 344.21, 6

[56] References Cited

U.S. PATENT DOCUMENTS

| | | | |
|---|---|---|---|
| 1,073,419 | 9/1913 | Howard | 297/174 |
| 2,375,907 | 5/1945 | Farmer | 5/86.1 |
| 2,609,862 | 9/1952 | Pratt | 5/81.1 |
| 4,266,305 | 5/1981 | Kavaloski | 297/6 |
| 4,737,997 | 4/1988 | Lamson | 5/81.1 |
| 5,054,852 | 10/1991 | Tholkes | 297/172 |
| 5,112,076 | 5/1992 | Wilson | 5/81.1 |
| 5,148,559 | 9/1992 | Morris | 5/86.1 |
| 5,257,425 | 11/1993 | Shinabarger | 5/81.1 |
| 5,355,538 | 10/1994 | Fulford | 5/83.1 |

FOREIGN PATENT DOCUMENTS

| | | | |
|---|---|---|---|
| 2815763 | 10/1979 | Germany | 5/86.1 |
| 995235 | 6/1965 | United Kingdom | 5/81.1 |

*Primary Examiner*—Flemming Saether
*Attorney, Agent, or Firm*—Swabey Ogilvy Renault

[57] ABSTRACT

A combination patient transporter and chair, comprising a base frame extending in a horizontal plane and having a front and rear portion. Wheels are mounted on the base, and a vertically adjustable first post is rigidly connected to the base frame, spaced from the rear portion and near the front portion. The first post includes mounting means spaced vertically from the base frame. A removable chair is provided having a backrest. The mounting means includes cantilevered connecting members mounting the chair in a cantilevered manner from the first post towards and over the rear portion. A vertically adjustable footrest means is provided over the base and is adjustable between an upper position and a lower position. A table platform is spaced forwardly and above the chair.

8 Claims, 4 Drawing Sheets

COMBINATION PATIENT TRANSPORTER CHAIR OR COMMODE

CROSS-REFERENCE TO RELATED APPLICATIONS

The present application is a continuation-in-part application of application Ser. No. 08/344,658 filed Nov. 18, 1994 now abandoned.

BACKGROUND OF THE INVENTION

1. Field of the Invention

The present invention relates to a combination patient transporter, chair, and commode which specifically facilitates the transfer of a patient to and from a bed and supports the personal needs and routine bedside activities of the patient.

2. Description of the Prior Art

Most patient care is administered bedside and, although medical technology is highly evolved, the routine, practical, logistical imperatives confronted by nurses and other care givers have been largely ignored.

For respiratory patients it is important for them to assume a characteristic sitting position which makes breathing easier, that is, leaning forward with elbows partially supporting the weight of the upper body, without obliging hospital staff to transfer them to an independent chair. Sitting semi-upright in a hospital bed with one's legs outstretched is not an optimal position for respiratory function in patients who are already short of breath, nor is it optimal for bowel movements.

It was our aim to provide bed hardware to allow a patient to sit up on the side of his bed, providing back support, optional lateral support and a table surface for a meal tray, reading materials or personal items. The variations in hospital bed design dictated that the hardware be independent of the bed frame.

Although many devices have been invented to facilitate patient transfer from a bed to a bath, bedside chair or wheelchair, few have been so commercially attractive as to be widely implemented, with the exception of the traditional patient lift, characterized by a single vertical post and a sling on a cantilevered arm. However, U.S. Pat. No. 4,719,655, Dean, issued Jan. 19, 1988, and U.S. Pat. No. 5,112,076, Wilson, issued May 12, 1992, show wheelchairs which are cantilevered and have lift capabilities to transfer a patient from a bed or chair to another. However, both the transporters shown in these patents have side posts which make it difficult to move laterally onto a bed or chair. Although the Dean patent has a removable rear section and a sling, it can only be used as a temporary transfer device.

As a result, hospital staff have been obliged to assume undue risk of personal injury by improvising in most instances and lifting and transferring patients without the benefit of any kind of appliance. The result has been a high incidence of back injuries with their implicit social costs.

Interest in the prevention of occupational injuries has increased in recent years in proportion to the increase in the allied costs.

SUMMARY OF THE INVENTION

It is a purpose of the present invention to facilitate the transfer of a patient with minimal effort on the part of an assistant and, therefore, minimal risk of injury.

It is a further purpose of the present invention to provide a unique design whose relative simplicity will result in a lower cost of manufacture and a greater ease of use and reliability, i.e., a more commercially attractive design.

In addition to facilitating the transfer of the patient from his bed, the patient transporter may also support various bedside activities and serve as a table and chair, commode, or wheelchair.

The present invention relates to a combined patient transporter, chair or commode for supporting a patient in a sitting position, transporting and transferring the patient to any desired place, comprising: a base frame extending in a horizontal plane and having a front and rear portion; wheels mounted on the base; a vertically adjustable, central post rigidly connected to the base frame, spaced from the rear portion and near the front portion, the post including support means spaced vertically from the base frame for supporting a chair having a backrest and an interchangeable seat pad or toilet seat; the support means including a beam forming a T with the central post, a pair of swivel blocks near each end of the beam; the chair, including a pair of parallel side frame members extending on either side of the backrest to be detachably engaged in the swivel blocks such that the chair is supported in cantilevered fashion to the swivel blocks and can be removed to allow a patient to move into position relative to the central post and to be partly surrounded by the chair when the chair is engaged to the pair of swivel blocks; the seat or toilet seat extends horizontally at least as high as the beam; a footrest supported above the base and forward of the central post and table means mounted to the base and spaced forward of the central post.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
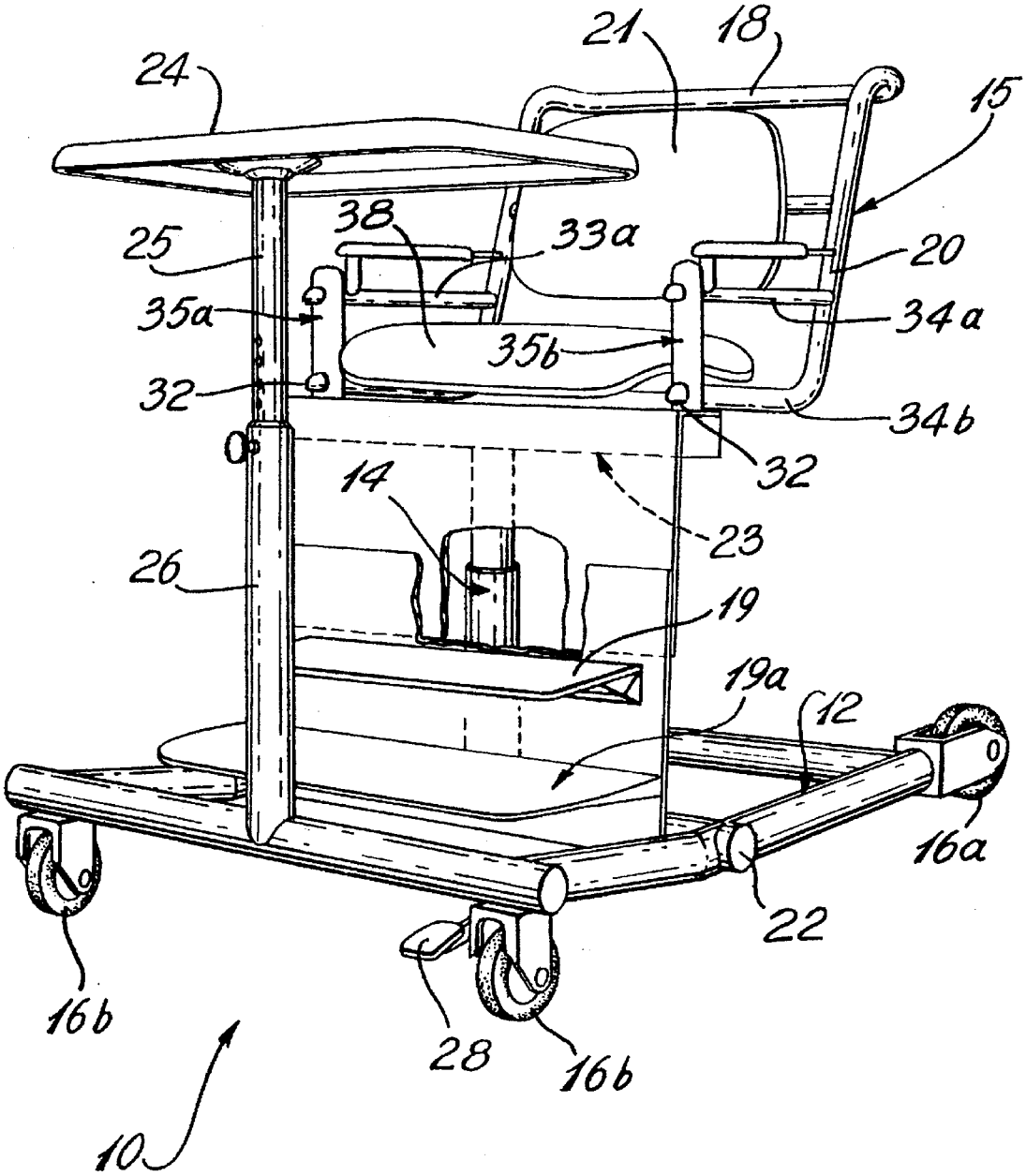
FIG. 1 is a perspective view of the patient transporter in accordance with an embodiment of the present invention.

The patient transporter 10 has a perimeter frame 12 and a central seat post 14.

The perimeter frame 12 has front, rear and side portion and is made of round steel tubes.

The perimeter frame 12 acts as a "bumper" in the case of collisions with door frames and other architectural and human impediments and permits the widest practical vehicle width consistent with standard doors.

The frame 12 is constructed so that the rear portion is as close to the ground as possible in order to allow the frame 12 to move under beds and automobiles. Thus the rear wheels 16a are journaled in brackets extending from the ends of the frame. The front wheels 16b are hospital style swivel-type casters so the patient transporter 10 may easily negotiate tight corners and confined spaces. The patient transporter 10 turns about a center on the middle of the axis of the rear fixed casters 16a and has as short a wheel base as possible without compromising overall vehicle stability. The front casters 16b are also lockable as to provide a totally stable seat base when parked next to the bed.

The central post 14 is mounted to a beam 22 fixed to the legs of the perimeter frame 12.

The single central vertical post 14 supports a cantilevered chair 15 at its front by means of a transverse support beam 23 forming a T with the post 14.

Figure 5:
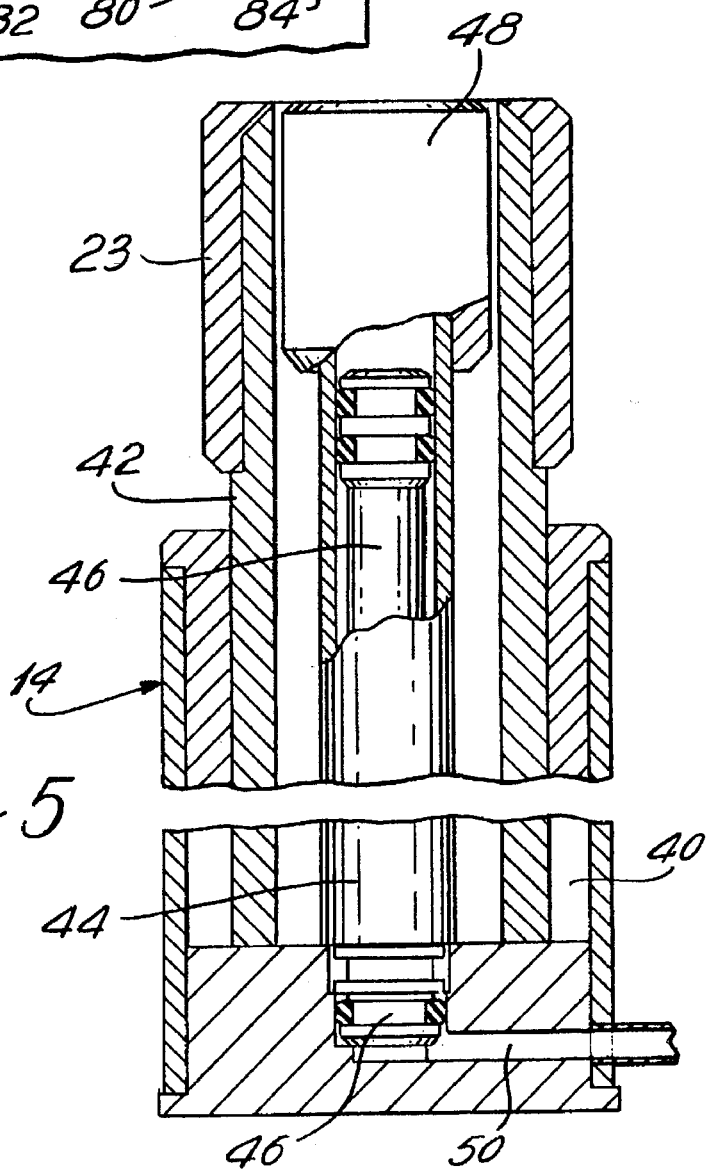
FIG. 5 is a fragmentary vertical cross-section taken along lines 5—5 of FIG. 2.

FIG. 5 shows the hydraulic mechanism of the post 14. A cylinder 40, and base 40a, is welded to the beam 22 and extends substantially mid-way of the post 14 when fully extended. A cylindrical tube 42 which mounts beam 23 telescopes within the cylinder 40. A hydraulic cylinder 44 is fixed to base 40a and extends concentrically with the cylinder 40. A piston 46 reciprocates in the hydraulic cylinder 44. The piston 46 is connected to the top of the tube 42 by means of a support block 48. An oil passage 50 allows oil to be pumped in by a small hydraulic pump, controlled by foot pedal 28, to engage the piston 46 and thus move the tube 42 and the structure including beam 23 upwardly. When it is required to lower the chair assembly, a valve, not shown, is operated to allow the oil to flow out of the hydraulic cylinder 44 through the passage 50.

The foot pedal 28 controls the movement of the chair 15 by means of a hydraulic pump by a link rod.

The table surface 24, whose height may be adjusted relative to the height of the chair 15, is supported by a tube 25 inside a post 26 fixed to the center of the bight of the perimeter frame 12. The tube 25 is provided with a series of apertures which can be selectively engaged by a locking pin provided in post 26.

The chair assembly includes a backrest 21 with side frame members 20 and a handle portion 18. In the present embodiment the side frame member 20 includes pairs of horizontal arms 33a, 33b, 34a, and 4b. Each horizontal arms 33a, 33b, 34a, and 34b includes a male plug 32 at the end thereof.

Swivel blocks 35a and 35b are mounted to each end of beam 23. Each includes an upper portion 52 and a lower portion 54 of smaller diameter than the upper portion 52. The shoulder formed between the upper portion 52 and the lower portion 54 acts as a bearing surface when the swivel block 35a or 35b is inserted into a bore 56 formed at each end of the beam 23.

Figure 6:
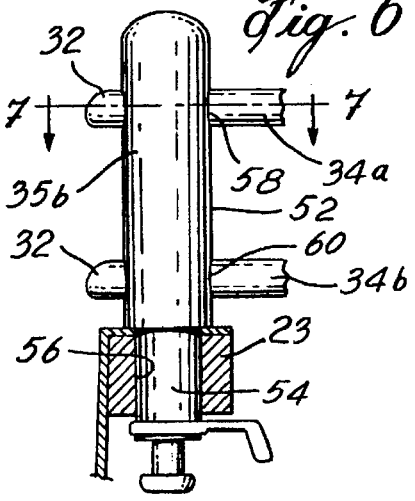
FIG. 6 is en enlarged side elevation of a detail of the embodiment shown in FIGS. 1 and 2.
Figure 7:
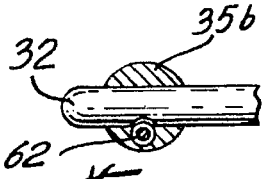
FIG. 7 is a horizontal cross-section taken along lines 7—7 of FIG. 6.
Figure 8:
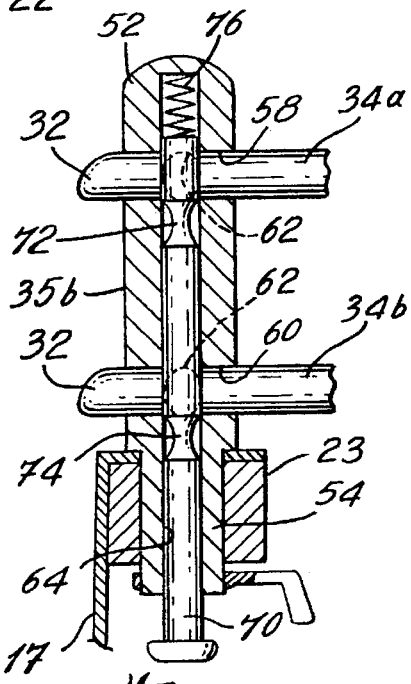
FIG. 8 is a vertical cross-section of the detail shown in FIG. 6.

As shown in FIGS. 6 and 7 the swivel block 35b includes a pair of horizontal bores 58 and 60 for receiving the plugs 32 of frame members 34a and 34b, respectively. Each of the plugs 32 has a cut-out or groove portion 62. A longitudinal bore 64 extends longitudinally through the swivel block 35b and intersects the bores 58 and 60 respectively. A detent pin 70 slides in the bore 64 and has annular grooves 72 and 74, which when aligned with the bores 58 and 60, allows the plugs 32 to be removed or inserted in the bores. The detent pin 70 is urged by the spring 76 to be out of phase with the plugs 32 such that the detent pin 70 normally retains the frame members 34a and 34b locked within the bores 58 and 60.

Figure 4:
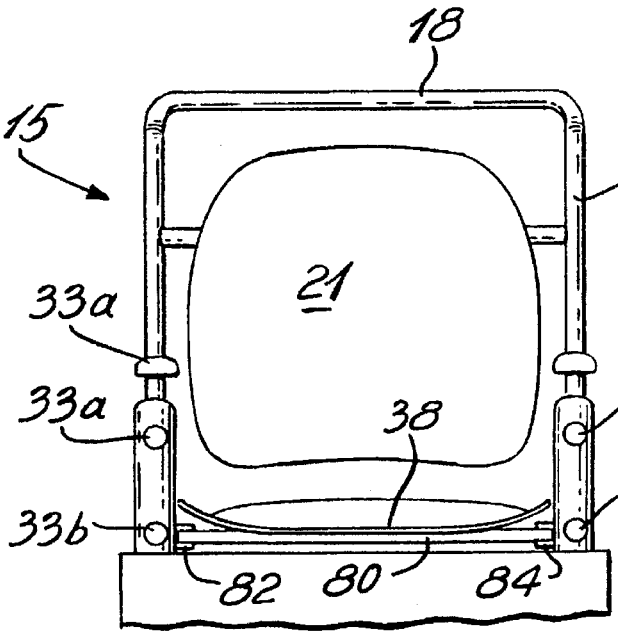
FIG. 4 is a vertical cross-section taken along lines 4—4 of FIG. 2.

The chair 15 is also provided with a seat 38 having a slide platform 80. Tracks 82 and 84 are fixed to frame members 33b and 34b respectively which extend parallel to each other facing inwardly as shown in FIG. 4. The platform 80 is adapted to slide in the tracks 82 and 84. Alternatively a toilet seat 39 may be slid into the tracks 82 and 84.

Figure 2:
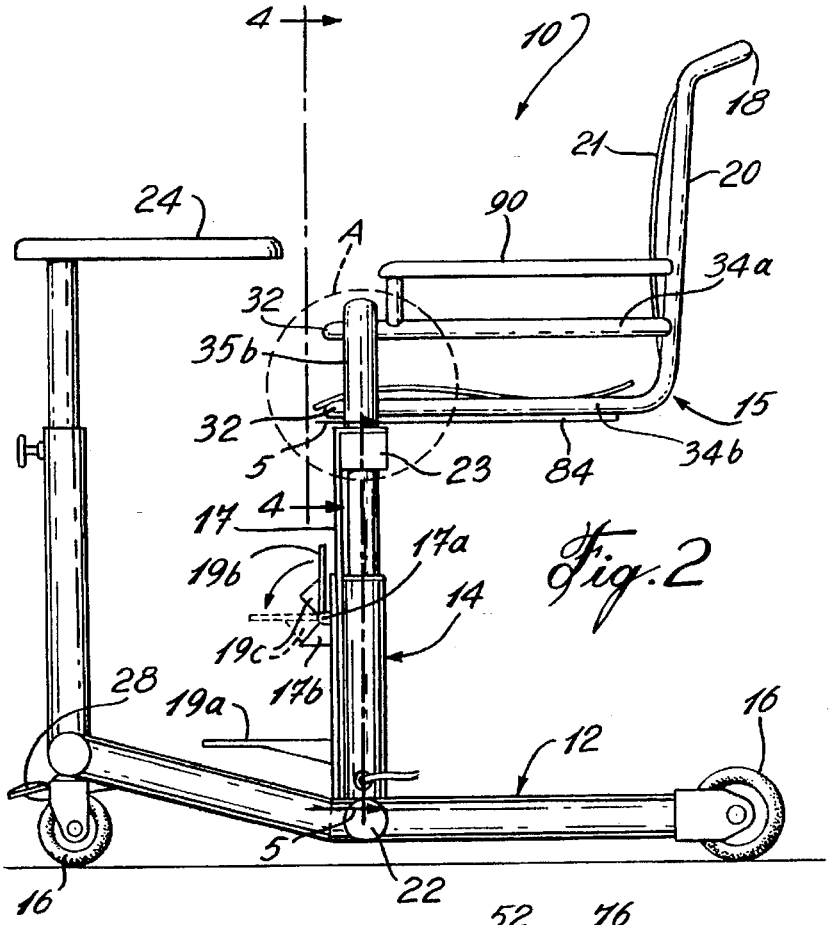
FIG. 2 is a side elevation of an embodiment of the present invention.

As shown in FIG. 2 a footrest 19a is provided to allow the patient to pivot forwardly to allow the seat 38 to be inserted under the patient's buttocks. If the patient is shorter or if the patient so desires, a second footrest 19b hinged to the support 17 can be deployed to a horizontal position about the hinge axis 17a as shown in dotted lines in FIG. 2a. The footrest 19b includes a block 19c which engages a complementary block 17b mounted to the support 17, thereby supporting the footrest 19b in the horizontal position. A spring hinge 17a provides the hinge correction of footrest 19b.

The support 17 is mounted to the beam 23.

Figure 3:
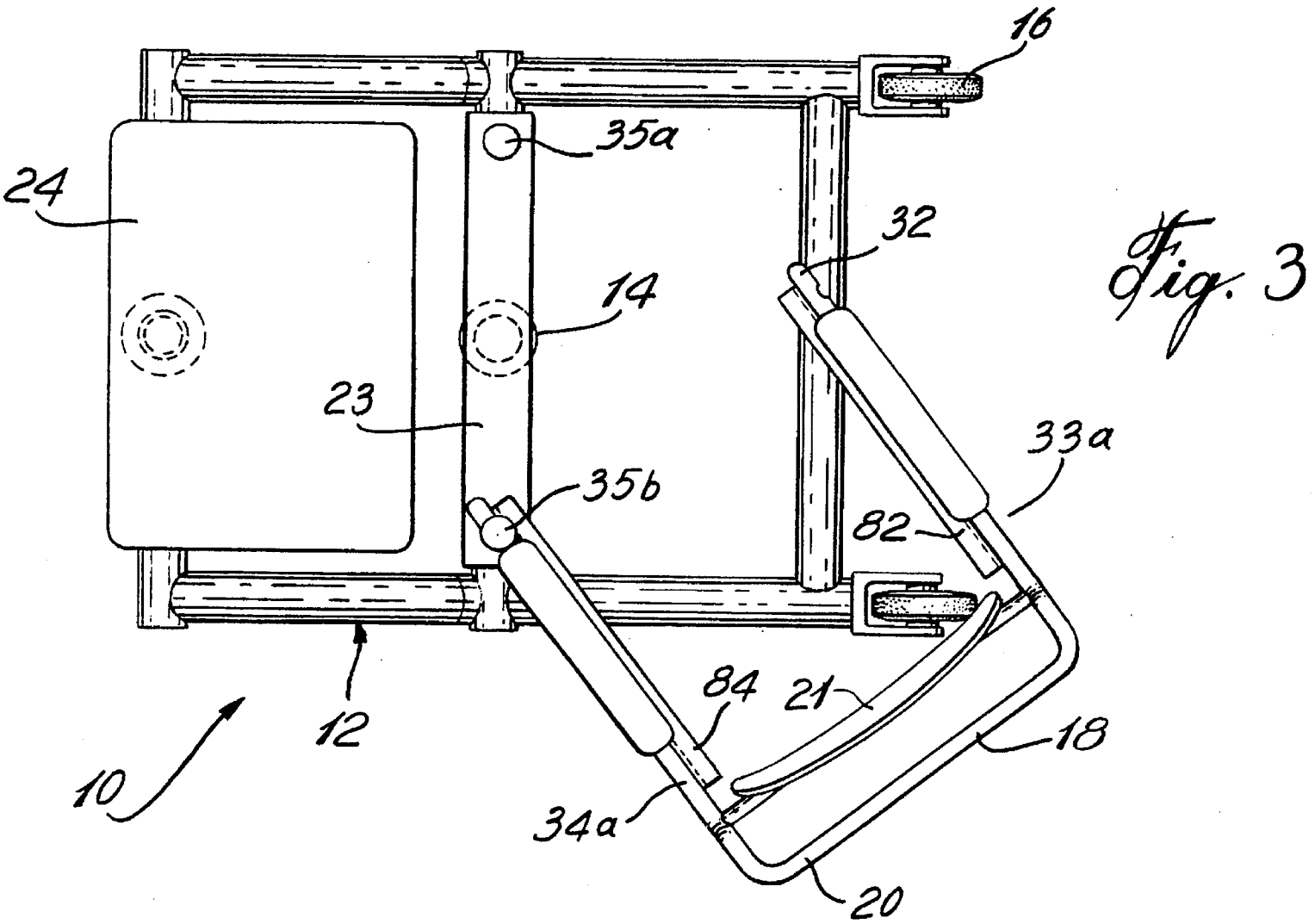
FIG. 3 is a top plan view of the embodiment of the invention shown in FIGS. 1 and 2 but with a detail in a different operative position.

In operation, the transporter 10 can be moved up to a bed as shown in FIG. 3 with the chair 15 open. The frame 20 is rotated about the axis of swivel block 35b. Thus, the plugs 32 of frame members 33a an 33b have been released from the swivel block 35a by operating the detent pin 70 in the swivel block 35a. The rear portion of the base 12 extends underneath the bed. Thus, the frame 20 can rotate over the bed and the patient is helped to be moved with the legs over the beam 23 in the space between the post 14 and the post 26. (The swivel block 35a can be removed from the beam 23 for easier access for the patient.) Once the patient is in a seated position on the side of the bed with the feet supported on footrest 19a or 19b, the frame 20 can be rotated counterclockwise as shown in FIG. 3 until the plugs 32 of frame member 33a and 33b engage the swivel block 35a and are locked therein. The seat 38 or toilet seat 39 can then be slid in the tracks 82 and 84 underneath the patient as the patient leans forwards on the table 24 with the help of the footrest 19a or 19b.

Once the patient is completely supported by the transporter 10, the transporter 10 can be moved to various locations, including a bathroom or even outdoors to a car. It is merely necessary to operated the hydraulic post 14 to lower the chair 15 to the height of the automobile seat, after which the frame 20 can be pivoted about one of the swivel blocks 35a or 35b to allow the patient to slide on to the automobile seat.

The frame 20 can be removed completely from both swivel blocks 35a and 35b an then inserted into swivel blocks after the patient has been positioned to rotate slightly forward with the patient's elbows on the table 24.

Armrests 90 can also be provided. Typically the armrests 90 would be pivoted in a vertical plane to the frame 20.

Only one embodiment of the invention has been described herein. It is evident that while retaining the essential elements of the invention as set out in the claims, the various mechanical devices can be designed in many ways. The swivel blocks which have been described can take different versions, including frame members which have swivel blocks fixed to the ends thereof, and the lower portion 54 can be telescoped into the upper portion 52 to disengage the lower portion from the beam 23. Other constructions can also be contemplated.

We claim:

1. A combination patient transporter chair and commode for supporting a patient in a sitting position, comprising a base frame extending horizontally and having a front, rear and side portions, wheels mounted on the base frame, a vertically adjustable first post rigidly connected to the base frame, spaced from the front, rear and side portions and located closer to the front portion than the rear portion, the first post mounting a beam which extends generally laterally relative to the side portions of the base frame, a chair having a backrest and an interchangeable seat pad and toilet seat, the chair including a pair of parallel side frame members extending on either side of the backrest to be detachably engaged to the beam by means of swivel blocks and wherein the chair can be at least partially detached from the beam to allow a patient to move into a position relative to the beam; one of the seat pad and toilet seat extending horizontally at least as high as the beam; a footrest supported above the base frame and forward of the first post, and table means mounted to the base frame and spaced forward of the first post in the front portion of the base.

2. The combination patient transporter chair and commode as defined in claim 1, wherein the swivel blocks are separable from the beam and from the frame members of the chair.

3. The combination patient transporter chair and commode as defined in claim 1, wherein the side frame members of the chair include tubular members to which a track is provided on each side frame member facing one another, the seat pad and toilet includes track followers for engaging the tracks on the side frame members.

4. The combination patient transporter chair and commode as defined in claim 1, wherein the first post is a single post located generally midway between the side portions.

5. A combination patient transporter chair and commode as defined in claim 4, wherein the first post is a hydraulically operable telescopic post means for vertically adjusting the beam.

6. The combination patient transporter chair and commode as defined in claim 1, wherein the footrest is mounted to the beam and the height of the footrest can be adjusted relative to the beam.

7. A combination patient transporter chair and commode as defined in claim 1, wherein the table means includes a post extending and upwardly from the base frame generally midway between the side portions and the post can be adjusted vertically for locating the table relative to the chair.

8. A combination patient transporter chair and commode comprising a perimeter base frame formed of round metal tubes the perimeter base frame defines a front portion and a rear portion, wheels are provided on ends of the rear portion of the base frame, a hydraulic, vertically adjustable post centrally connected, to the base frame, a beam extending transversely of the post at a top thereof with mounting swivel female connecting members at each end thereof, a cantilevered removable chair having a backrest and two cantilevered tubular frame members formed with male connecting members at the ends thereof, said cantilevered chair being securely attached to the beam by engagement of the male connecting members in the female connecting members, a footrest means supported above the base frame and forward of the post having an upper support position and a lower support position, and another vertically adjustable post connected to the base frame mounting a table.

* * * * *